US009813807B2

(12) United States Patent
Epping

(10) Patent No.: US 9,813,807 B2
(45) Date of Patent: Nov. 7, 2017

(54) EAR-CANAL EARPIECE

(71) Applicant: Sennheiser electronic GmbH & Co. KG, Wedemark (DE)

(72) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/966,040

(22) Filed: Dec. 11, 2015

(65) Prior Publication Data

US 2016/0212529 A1 Jul. 21, 2016

(30) Foreign Application Priority Data

Dec. 15, 2014 (DE) ..... 10 2014 225 923

(51) Int. Cl.

| | |
|---|---|
| ***H04R 3/00*** | (2006.01) |
| ***H04R 1/10*** | (2006.01) |
| ***H04R 1/34*** | (2006.01) |
| ***H04R 7/26*** | (2006.01) |
| ***H04R 1/28*** | (2006.01) |
| *H04R 25/00* | (2006.01) |

(52) U.S. Cl.

CPC ..... *H04R 3/002* (2013.01); *H04R 1/1016* (2013.01); *H04R 1/2857* (2013.01); *H04R 1/345* (2013.01); *H04R 7/26* (2013.01); *H04R 1/1075* (2013.01); *H04R 25/652* (2013.01); *H04R 25/654* (2013.01); *H04R 2460/09* (2013.01); *H04R 2460/11* (2013.01)

(58) Field of Classification Search

CPC ..... H04R 25/60; H04R 25/65; H04R 25/602; H04R 2225/31; H04R 2225/33; H04R 2460/13; H04R 1/1016

USPC ..... 381/322, 324, 328, 380

See application file for complete search history.

(56) References Cited

U.S. PATENT DOCUMENTS

| | | | | |
|---|---|---|---|---|
| 4,712,245 | A | 12/1987 | Lyregaard | |
| 4,729,451 | A * | 3/1988 | Brander | H04R 25/604 181/130 |
| 5,195,139 | A * | 3/1993 | Gauthier | H04R 25/02 181/130 |
| 5,844,998 | A * | 12/1998 | Nageno | H04R 1/2842 381/371 |
| 6,359,993 | B2 * | 3/2002 | Brimhall | 381/322 |
| 7,079,662 | B2 * | 7/2006 | Niederdr nk | H04R 25/652 381/322 |
| 8,054,985 | B2 * | 11/2011 | Doty | A61F 11/08 381/322 |
| 8,295,531 | B2 * | 10/2012 | Lin | H04R 1/1091 381/328 |

(Continued)

FOREIGN PATENT DOCUMENTS

| | | |
|---|---|---|
| DE | 10 2006 008 044 | 5/2007 |
| EP | 2 819 428 | 12/2014 |
| WO | WO 2013/123626 | 8/2013 |

*Primary Examiner* — Suhan Ni

(74) *Attorney, Agent, or Firm* — Haug Partners LLP

(57) ABSTRACT

An ear-canal earpiece having an electroacoustic sound transducer, a sound guide unit having a first and a second end for guiding the sound from the electroacoustic sound transducer to an ear of a user and at least one portion. The ear canal earpiece has a canal having a first end open towards the ear canal and a second outwardly open end. A diaphragm is provided in the canal and extends over the entire cross-section of the canal.

16 Claims, 15 Drawing Sheets

(56) References Cited

U.S. PATENT DOCUMENTS

| | | | | |
|---|---|---|---|---|
| 9,344,791 | B2 * | 5/2016 | Zhao | H04R 1/1016 |
| 2004/0218772 | A1 * | 11/2004 | Ryan | H04R 25/456<br>381/328 |
| 2012/0087511 | A1 | 4/2012 | Lumsden et al. | |
| 2013/0148830 | A1 | 6/2013 | Sakaguchi et al. | |

* cited by examiner

EAR-CANAL EARPIECE

The present application claims priority from German Priority Application No. 10 2014 225 923.1 filed on Dec. 15, 2014, the disclosure of which is incorporated herein by reference in its entirety.

FIELD OF THE INVENTION

The invention concerns an ear canal earpiece.

Ear canal earpieces generally have an acoustic sound transducer installed in a housing which is fitted intra-aurally, that is to say into the ear canal. Frequently an ear pad is arranged around the housing so that it becomes more pleasant for the user to wear the ear canal earpiece in the ear and to provide that the earpiece is sealed in the ear canal. Disposed on the housing is an electrical connection for a cable carrying an electric signal to the sound transducer.

To improve the wearing comfort for the user and to achieve a higher level of fitment sealing for the earpiece in the ear canal the earpieces can be fitted into an otoplastic means, here also referred to as an ear-customized ear canal earpiece.

In addition an ear canal earpiece may not be provided with an ear pad, but may be fixed to an otoplastic means. In that case the otoplastic means and the earpiece are not one unit but can be separate. The otoplastic means is here referred to as an earmold portion.

The advantages of an ear-customized solution are a secure fit for the earpiece in the ear canal and better bass reproduction due to the earpiece being better sealed off.

When an ear canal earpiece is fitted into the ear canal of a user then the ear canal earpiece substantially air-tightly closes the ear canal. The sound emitted by the sound transducer thus passes from the ear canal earpiece by way of the ear canal to the eardrum of the user. That however can have the result that the user perceives the external noise only in highly damped fashion. When listening to music for example on the street the result of this can be that approaching motor vehicles or other sources of danger are not perceived by the user. That can also have the result for example in regard to a musician who is on a stage that he feels isolated from the rest of the music. To avoid that it is possible to provide a so-called ambient canal connecting the ear canal to the outside world. The provision of such a canal however means that the ambient sound reaches the user only in severely restricted quality and in addition has an adverse influence on the acoustic properties of the earpiece.

In the German patent application from which priority is claimed the German Patent and Trade Mark Office searched the following documents: WO 2013/123626 A1, EP 2 819 428 A1, DE 10 2006 008 044 B3, U.S. Pat. No. 4,712,245 A, US 2013/148830 A1 and US 2012/087511 A1.

SUMMARY OF THE INVENTION

The object of the present invention is to improve the sound quality of an earpiece, in particular to allow the ambient sound to pass to the eardrum with adequate quality and at the same time to permit a high sound quality.

That object is attained by an ear canal earpiece as set forth in claim 1.

Thus there is provided an ear canal earpiece having an electroacoustic sound transducer, a sound guide unit having a first and a second end for guiding the sound from the electroacoustic sound transducer to an ear of a user. The ear canal earpiece has a canal having a first end which is open towards the ear canal and a second end which is open outwardly. An oscillatable diaphragm has a closed surface and is provided in the canal and extends for example with the diaphragm clamping means over the entire cross-section so that it can seal off the canal.

An ambient function can be ensured by the provision of the canal. The term ambient function is used to denote a transmission of external noises to the ear of a user in spite of the fitted ear canal earpiece. There are different demands on the quality of transmission, in dependence on the application involved. A measurement in respect of quality is the transfer function of the canal, that is to say the frequency response of the sound transmitted through the canal. The provision of the oscillatable diaphragm in the canal makes it possible to improve the transfer function of the canal and effectively limit the adverse effects on the acoustics of the earpiece.

According to an aspect of the present invention there is provided a first damping unit in the region of the first end of the canal and/or a second damping unit in the region of the second end of the canal.

According to a further aspect of the present invention the first and/or second damping unit serves to influence the frequency response of the sound transmitted through the canal or as protection against fouling.

According to a further aspect of the present invention the diaphragm is in the form of a flat diaphragm, a flat tensioned diaphragm or an embossed diaphragm with a dome portion and a bead portion.

According to a further aspect of the present invention the canal extends at least partially parallel to the sound guide unit.

According to a further aspect of the present invention the cross-section of the canal is round, oval or rectangular or of any shape.

According to a further aspect of the present invention the cross-section of the canal is not constant over its length.

According to a further aspect of the present invention the canal has a first portion which is delimited by an inside wall of a third sound guide portion of the sound guide unit.

According to a further aspect of the present invention the canal has a (constricted) portion to be able to receive a diaphragm support of the diaphragm and the diaphragm.

According to a further aspect of the present invention the canal is of a two-part configuration and the diaphragm possibly with its diaphragm suspension means is provided between the two parts of the canal.

Further developments of the invention are recited in the appendant claims.

The embodiments by way of example and the advantages of the present invention are described more fully hereinafter with reference to the accompanying drawings.

DETAILED DESCRIPTION OF THE EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The invention concerns so-called ear canal earpieces, namely earpieces which are fitted to an ear canal of a user for example by means of an ear pad, an earmold portion or by way of an otoplastic means. The electroacoustic reproduction transducer can represent an electrodynamic, electrostatic or magnetic transducer. The sound is then guided from the electroacoustic transducer by the transducer into the rear part of the ear canal of the user.

Figure 1:
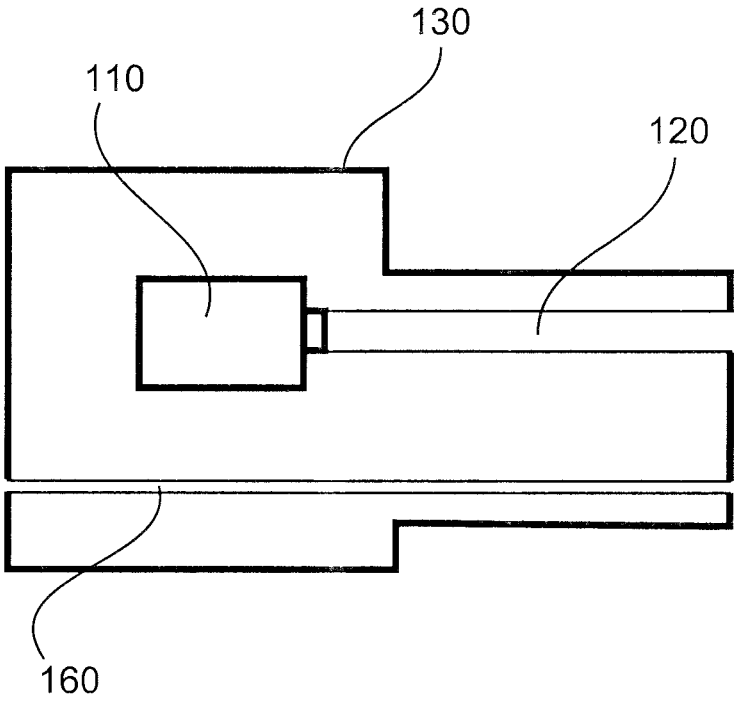
FIG. 1 shows a diagrammatic sectional view of an ear canal earpiece with an ambient canal according to the state of the art.

FIG. 1 shows a diagrammatic sectional view of an ear canal earpiece with ambient canal in accordance with the state of the art. The earpiece has an electroacoustic reproduction transducer 110 and a sound guide unit 120. The earpiece further has a canal 160 which is outwardly open with one end and which is open in the direction of the ear with the other end.

The reproduction transducer, the sound guide unit and the canal can be fitted in an otoplastic means 130.

Figure 2:
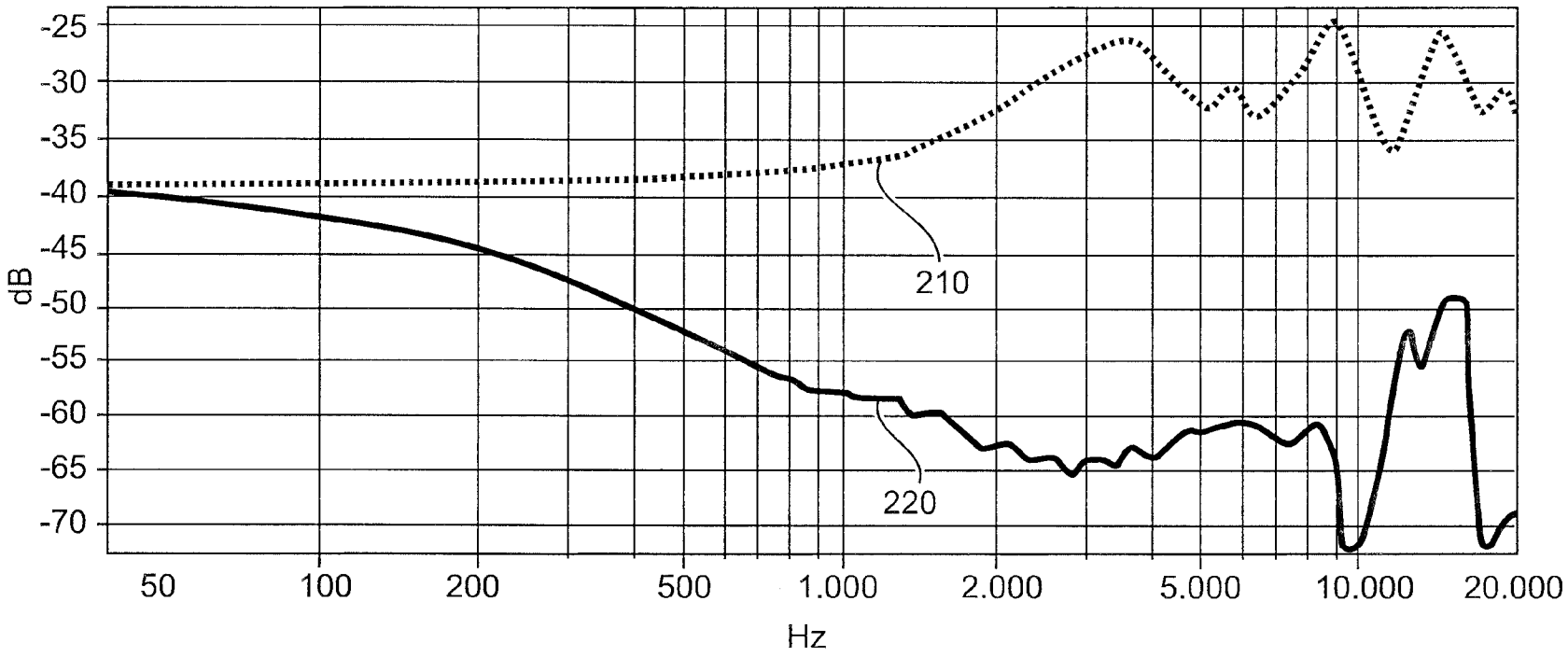
FIG. 2 shows a transfer function of an open ear canal and a transfer function of an ambient canal in accordance with the state of the art.

FIG. 2 shows a transfer function of an open ear canal and a transfer function of an ambient canal of an ear canal earpiece inserted into an ear canal. FIG. 2 shows the transfer function 210 of an open ear canal. That frequency response is a measure of how the sound passes from the outer ear to the eardrum. The transfer function of the ambient canal 220 is a measure of how the sound passes through the ambient canal to the eardrum.

It can be clearly seen from FIG. 2 that only the lowest frequencies reach the eardrum without relevant damping. In particular the frequency range of between 1000 Hz and 5000 Hz is passed with only very severe damping. In that respect it should be noted that it is precisely that region that is important for comprehension.

Particularly for musicians it is important that the frequencies above 5000 Hz are also still passed well.

Figure 3:
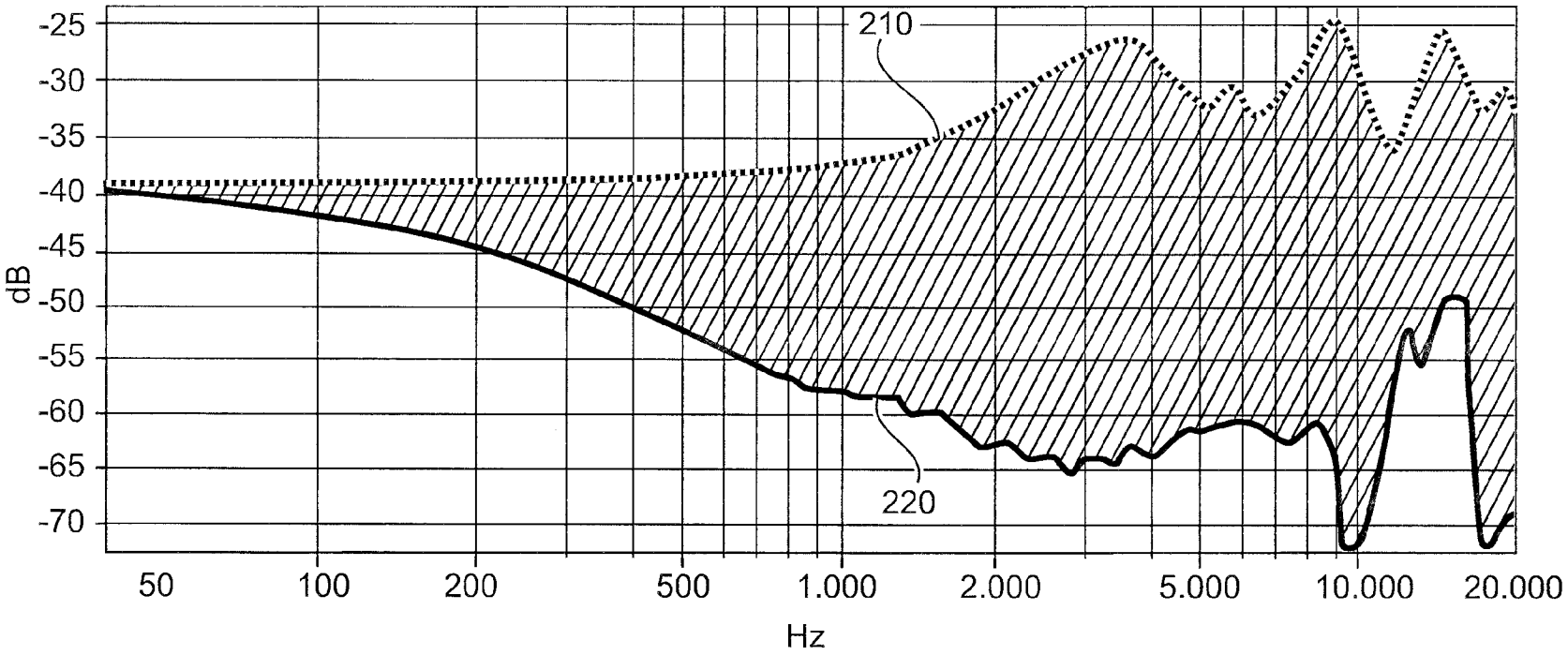
FIG. 3 shows a transfer function of an open ear canal and a transfer function of an ambient canal in accordance with the state of the art.

FIG. 3 shows the difference between the transfer functions of FIG. 2 in graphically emphasized form.

Figure 4:
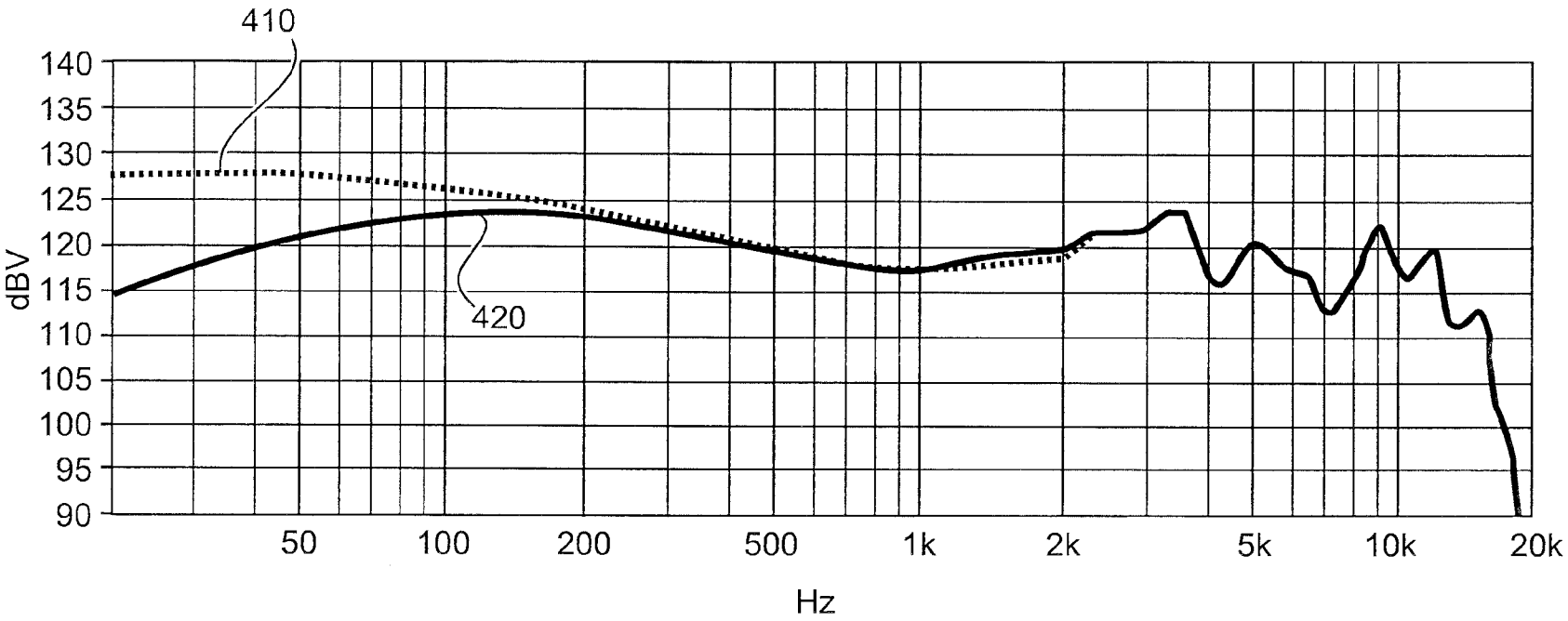
FIG. 4 shows a frequency response of the earpiece in which the canal is opened or closed in accordance with the state of the art.

FIG. 4 shows a frequency response of an ear canal earpiece with opened (420) and closed (410) canal in accordance with the state of the art. It can be seen from the difference between those two curves 410, 420 that the frequency response below 200 Hz is lowered by the ambient canal by more than 12 dB. That is unacceptable for many users and also cannot be overcome by further adaptation alterations to the ear canal earpiece.

In the state of the art therefore there are two serious disadvantages which the solution according to the invention seeks to improve: 1. the quality of the transfer function is unsatisfactory, and 2. the frequency response of the earpiece is negatively altered by the ambient canal in an inadmissible fashion.

Figure 5A:
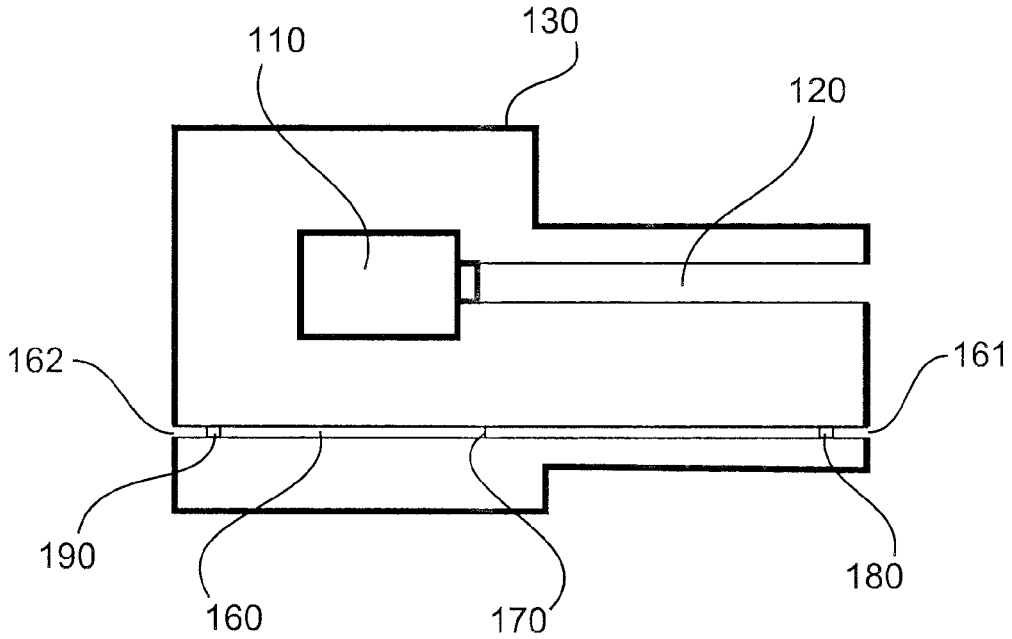
FIG. 5A shows a diagrammatic sectional view of an ear canal earpiece in accordance with a first embodiment.

FIG. 5A shows a diagrammatic sectional view of an ear canal earpiece in accordance with a first embodiment. The earpiece 100 has an electroacoustic reproduction transducer 110 and a sound guide unit 120. The sound guide portion 120 is provided in the region of a volume in front of a diaphragm of the electroacoustic transducer 110.

The earpiece further has a canal 160 having a first end 161 which is open in the direction of the eardrum and a second end 162 which is open outwardly. The earpiece has a housing 130 which for example surrounds the electroacoustic reproduction transducer 110. The second end 162 of the canal 160 can be provided in the housing wall. Provided in the canal 160 is an oscillatable diaphragm 170 which has a closed surface and which extends over the entire cross-section of the canal 160. In that way the diaphragm 170 can (mechanically and partially acoustically) seal off the canal 160.

Optionally a first damping element 180 can be provided in the region of the first end 161 of the canal 160 and optionally a second damping element 190 can be provided in the region of the second end 162 of the canal 160. The first and/or second damping unit 180, 190 can be provided for influencing the frequency response of the sound transmitted through the canal. Alternatively or additionally thereto the first and second damping unit 180, 190 can serve as protection in particular in relation to fouling.

Figure 5B:
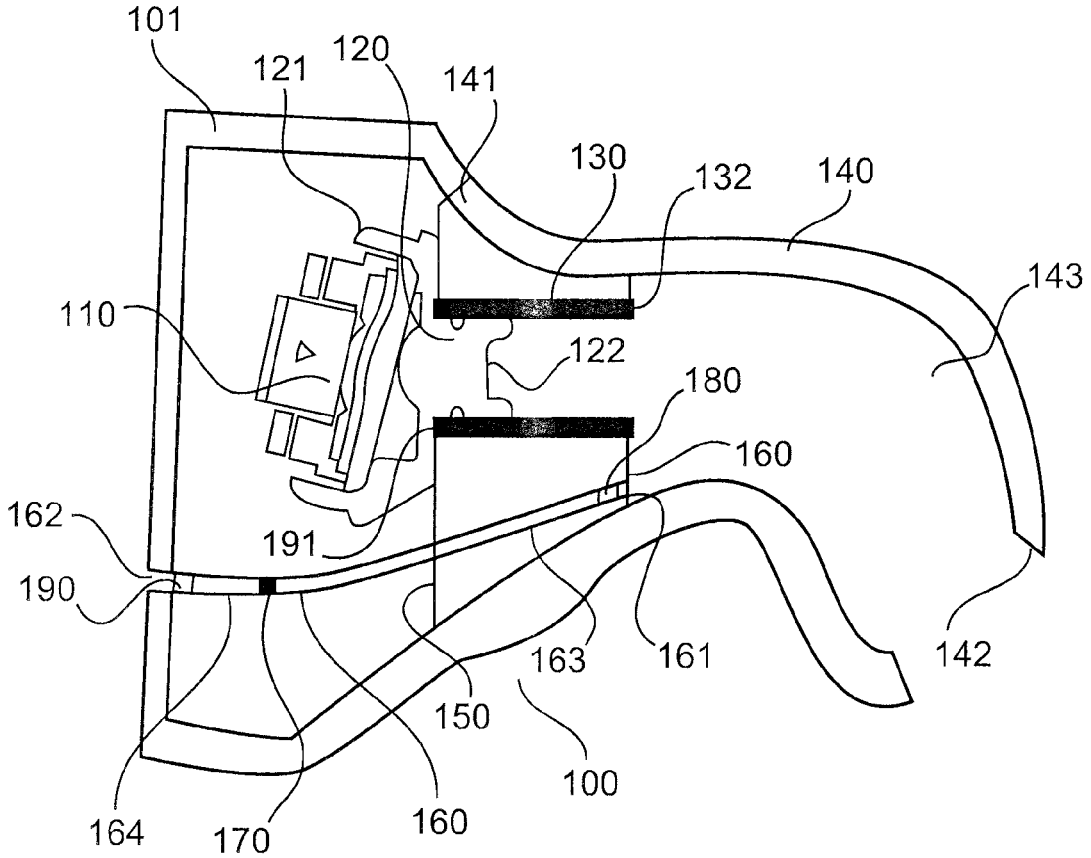
FIG. 5B shows a diagrammatic sectional view of an ear canal earpiece in accordance with a second embodiment.

FIG. 5B shows a diagrammatic sectional view of an ear canal earpiece in accordance with a second embodiment. The earpiece 100 has an electroacoustic reproduction transducer 110, a sound guide unit optionally with a first sound guide portion 120, a second sound guide portion 130 and a third sound guide portion 140. The first sound guide portion 120 is provided in the region of a volume in front of a diaphragm of the electroacoustic transducer 110. The third sound guide portion 140 can be in the form of an earmold portion or an otoplastic means. Its outside contour is matched to the inside contour of an ear canal. The second sound guide portion 130 serves to prolong the first sound guide portion 120. Optionally the second sound guide portion can be cylindrical. The length and the diameter of the sound guide of the second sound guide unit 130 can be such that the acoustic mass of the first and second sound guide portions 120, 130 together with the volume in front of the diaphragm of the transducer 110 produce a resonance frequency which enlarges the frequency response by the desired proportions.

The earpiece further has a canal 160 having a first end 161 which is open in the direction of the third sound guide portion 140 and a second end 162 which is open outwardly. The earpiece has a housing 101 which for example surrounds the electroacoustic transducer 110. The second end 162 of the canal 160 can be provided in the housing wall. Provided in the canal 160 is an oscillatable diaphragm 170 which has a closed surface and which extends over the entire cross-section of the canal 160 so that the canal 160 is (mechanically and partially acoustically) sealed off by the diaphragm 170. Optionally a first damping element 180 can be provided in the region of the first end 161 of the canal 160 and optionally a second damping element 190 can be provided in the region of the second end 162 of the canal 160. The first and/or second damping unit 180, 190 can be provided for influencing the frequency response of the sound transmitted through the canal. Alternatively or additionally thereto the first and second damping unit 180, 190 can serve as protection in particular in relation to fouling.

The first sound guide portion 120 has a first end 121 and a second end 122. The second end 122 is arranged at the side towards the ear while the first end 121 is provided at the side remote from the ear and can accommodate the electroacoustic transducer 110. The second sound guide portion 130 has a first end 131 at the side remote from the ear and a second end 132 at the side towards the ear. The third sound guide portion has a first end 141 at the side remote from the ear and a second end 142 at the side towards the ear.

The second sound guide portion 130 optionally has a sound wall 150 to provide a clearly delimited acoustic termination. The sound wall 150 can optionally be of an acoustically substantially sealed nature. The front side of the electroacoustic transducer is acoustically separated from the rear side of the transducer by the acoustically substantially sealing sound wall 150. The sound wall 150 can also be in the form of part of the third sound guide portion 140 or a separate part and can be introduced into a first end 141 of the third sound guide portion 140.

The sound wall 150 and the first sound guide portion 120 are provided in an internal volume 143 of the third sound guide unit 140, preferably in the region of the first end 141.

Optionally the sound wall 150 terminates with the first and second ends 131, 132 of the second sound guide portion 130.

Optionally the third sound guide portion 140 is of a cross-section or inside diameter which is larger than the cross-section or inside diameter of the second sound guide portion 130.

The outside contour of the third sound guide portion 140 is substantially adapted to the inside contour of the ear canal. The thickness of the third sound guide portion 140 is as thin as possible. In that respect a compromise has to be selected between a thickness which is as small as possible of the third sound guide portion 140 in regard to acoustics on the one hand and a minimum wall thickness in order on the other hand to provide a certain mechanical stability for the third sound guide portion 140.

Optionally the first, second and third sound guide portions can be in the form of one part or in the form of separate parts.

Preferably the third sound guide portion 140 does not have any constriction in regard to the geometry of the ear canal.

The outside contour of the third sound guide portion 140 very substantially follows the inside contour of the ear canal of the user.

The second and third sound guide portions 130, 140 can be adapted to be removable from the transducer 110 and the first sound guide portion 120.

Figure 5C:
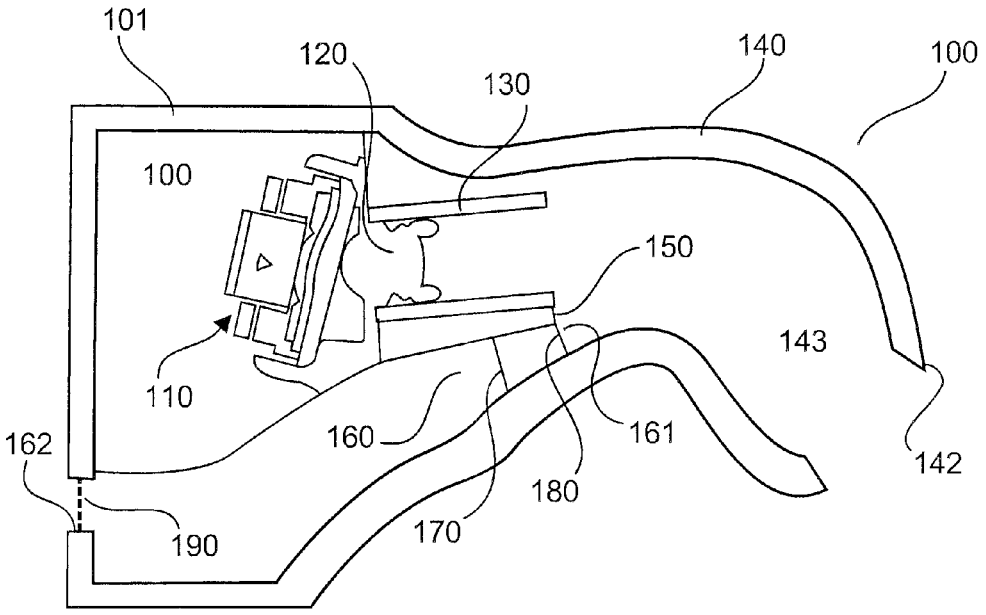
FIG. 5C shows a diagrammatic sectional view of an ear canal earpiece in accordance with a third embodiment.

FIG. 5C shows a diagrammatic sectional view of an ear canal earpiece in accordance with a third embodiment. The structure of the ear canal earpiece shown in FIG. 5C substantially corresponds to the structure of the ear canal earpiece shown in FIG. 5B, wherein the canal 160 is of a different configuration. While in the embodiment of FIG. 5B the canal is only of a small diameter the canal 160 in accordance with the second embodiment is substantially wider and can extend from the inside diameter or the inside wall of the third sound guide portion 140 to the sound wall 150 in the region of the second sound guide portion 130. Optionally a first damping unit can be provided at the first end 161 of the canal 160 and/or a second damping unit 190 can be provided at the second end 162 of the canal 160. The canal 160 can have a first portion 163 and a second portion 164, the first portion 163 being defined between the sound wall 150 and the inside wall of the third sound guide portion 140. The second portion 164 of the canal 160 can be separated by a wall from the rest of the internal volume of the housing.

Thus, the canal 160 can be provided parallel to the second sound guide portion 130, the canal 160 outwardly connecting a volume 143 formed by the third guide portion 140 together with the ear canal. The canal can be of a round, rectangular or any desired cross-section. The cross-section of the canal can alter along the length of the canal.

A for example yielding and oscillatable diaphragm 170 can be provided in the canal in such a way that it covers the entire cross-section of the canal and mechanically seals off the canal.

Figure 6:
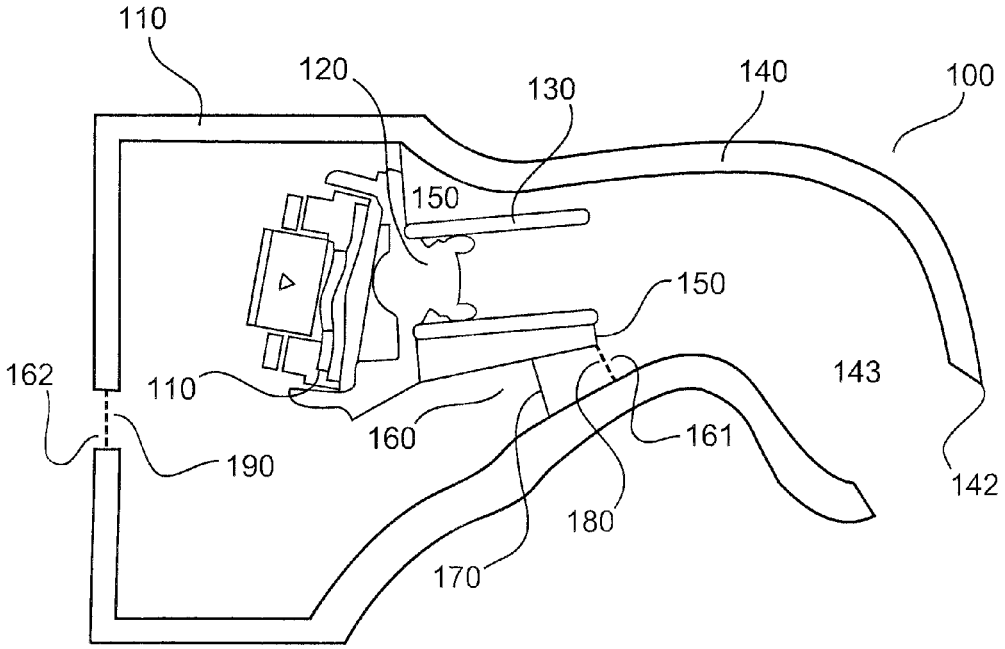
FIG. 6 shows a diagrammatic sectional view of an ear canal earpiece in accordance with a fourth embodiment.

FIG. 6 shows a diagrammatic sectional view of an ear canal earpiece in accordance with a fourth embodiment. The structure of the ear canal earpiece in accordance with the fourth embodiment substantially corresponds to that of the ear canal earpiece in accordance with the third embodiment. The ear canal earpiece also has a canal 160 with a first end 161 optionally with a first damping unit and a second end 162 optionally with a second damping unit 190. In contrast to the ear canal earpiece in accordance with the second embodiment the second portion 164 of the canal is not separated from the further internal volume of the housing.

The oscillatable diaphragm 170 in accordance with one of the embodiments can be in the form of a flat diaphragm, a flat tensioned diaphragm or an embossed diaphragm for example with a dome portion and a bead portion. The diaphragm can also have a diaphragm clamping means 171, the diaphragm and the clamping means extending over the entire cross-section of the canal 160. That has the result that the canal is acoustically divided by the diaphragm.

The diaphragm 170 can seal off the volume 143 for frequencies below its resonance frequency, that being achieved to a better degree, the stiffer the diaphragm is. At the same time the diaphragm 170 can pass the sound entering from the exterior by way of the second opening 162, that is to say the ambient noises, by way of the opening 162 and by way of the third sound guide portion 140 to the eardrum of the user. The stiffer the oscillatable diaphragm is, the correspondingly less sound reaches the eardrum. Thus the demands on the diaphragm in terms of a minimum influence on the earpiece frequency response and transmission with as little damping as possible of external noises are contradictory. In that respect it should be noted that it is generally not appropriate for the ambient sound to be allowed to pass undamped to the eardrum. For example, when listening to music, hearing the ambient noises in undamped fashion can markedly adversely affect enjoyment of the music. For example in the case of an in-ear monitoring system on a loud stage the undamped transmission of external noises can be damaging to the ear. According to the invention therefore there is afforded a possible way of only slightly influencing the earpiece frequency response and at the same time allowing the sound to pass with a frequency response adapted to the uses involved and appropriately damped. The influence on the earpiece frequency response would be taken into account in development of the earpiece and would be compensated with simple measures.

The first and second damping units 180, 190 can serve both for influencing the frequency response and also to avoid fouling.

Figure 7A:
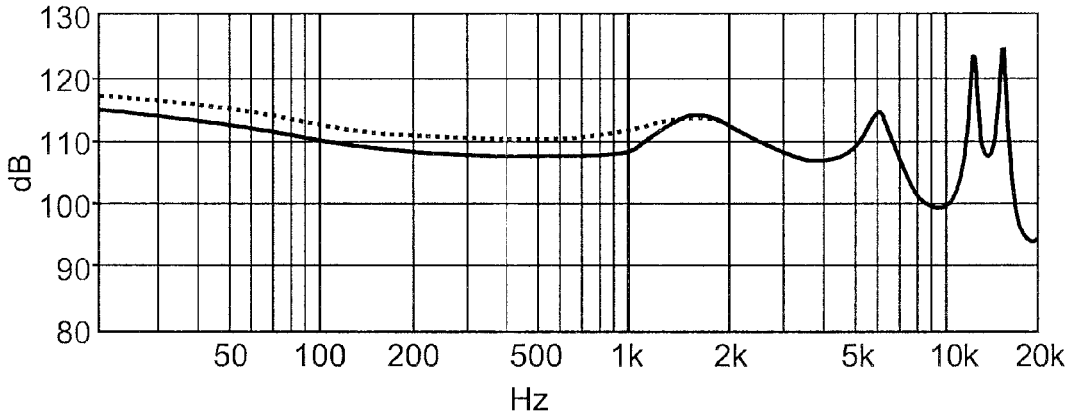
FIG. 7A shows a frequency response of an ear canal earpiece with open and closed canal in accordance with an embodiment of the invention.

FIG. 7A shows a frequency response of an ear canal earpiece with an opened and closed canal. FIG. 7A shows a frequency response 710 for an earpiece without a canal and a frequency response 720 for an earpiece with a canal. In those regions in which the flexibility of the diaphragm 170 has its effect the frequency response can be lowered by 2 dB. That is effected as the volume on which the earpiece acts can be virtually increased by the diaphragm. As the change in the frequency response is relatively slight that change can be taken into account and compensated for when tuning the earpiece.

Figure 7B:
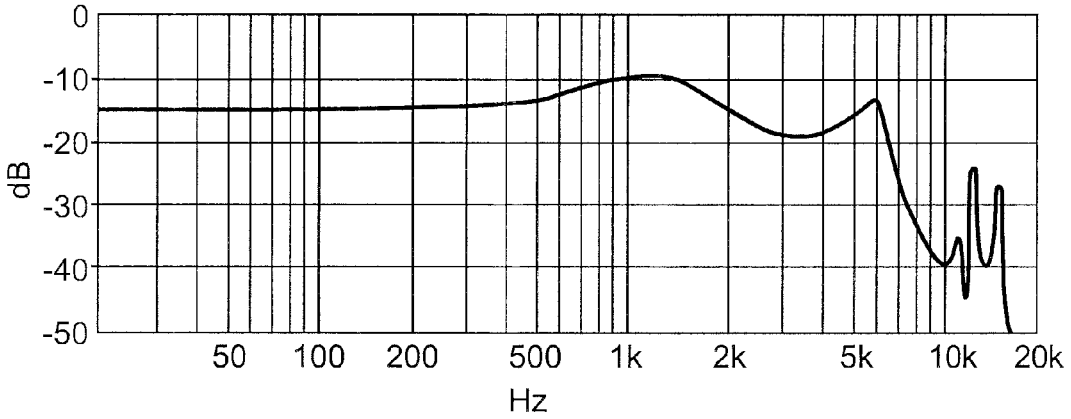
FIG. 7B shows a transfer function of an ambient canal in accordance with an embodiment of the invention.

FIG. 7B shows a transfer function of an ambient canal according to the invention. FIG. 7B shows in particular what frequency component of the ambient sound can pass through the ambient canal to the eardrum of the user. Thus FIG. 7B shows the damping of the ambient sound at the eardrum.

The frequency response of the ambient function can be seen from the acoustic interplay of the canal 160, the diaphragm 170, the damping elements 180, 190 and the sound guide means 140. It is possible to achieve a wide-band frequency response by a suitable design configuration for those components.

According to the invention it can therefore be provided that those frequency ranges which are important for understanding speech like for example 4 kHz are not subjected to any damping.

Figure 8:
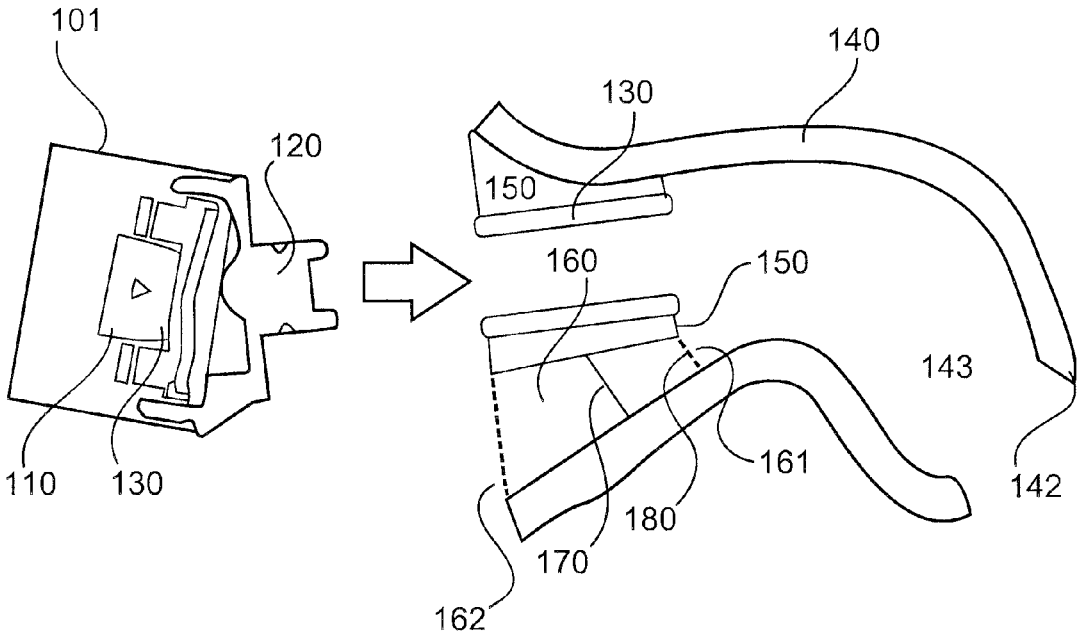
FIG. 8 shows a diagrammatic sectional view of an ear canal earpiece in accordance with a fifth embodiment.
Figure 9:
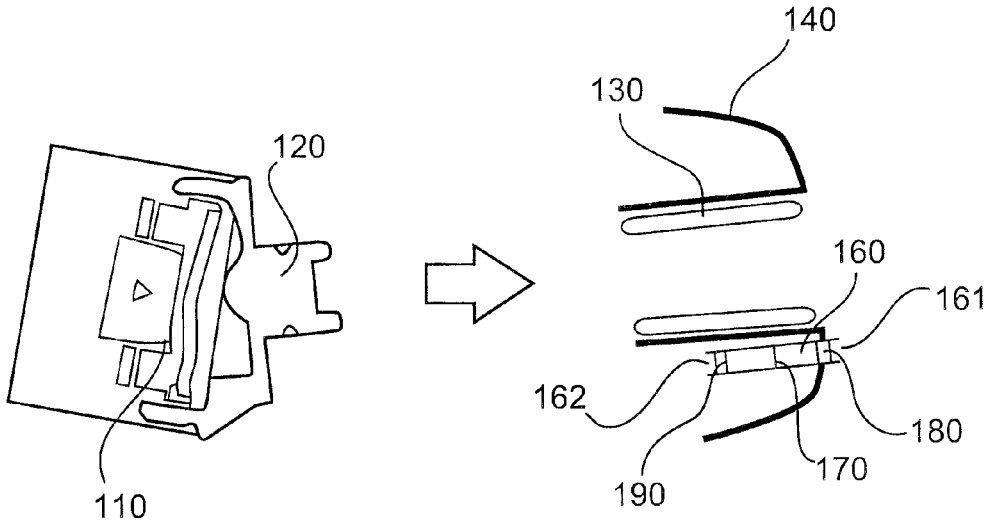
FIG. 9 shows a diagrammatic sectional view of an ear canal earpiece in accordance with a sixth embodiment.
Figure 10:
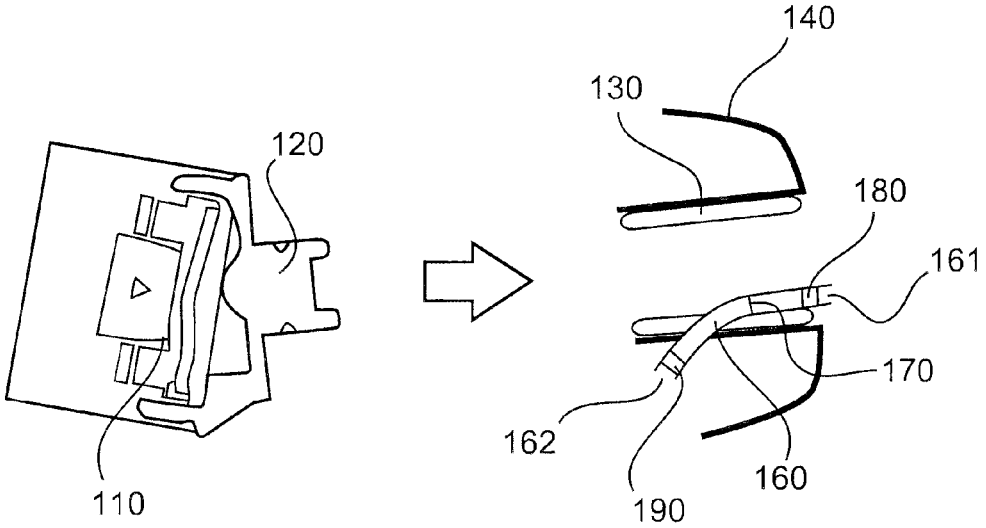
FIG. 10 shows a diagrammatic sectional view of an ear canal earpiece in accordance with a seventh embodiment.

FIGS. 8 through 10 each show a diagrammatic sectional view of an ear canal earpiece in accordance with a fifth, sixth and seventh embodiment. In the ear canal earpiece in accordance with this embodiment the sound guide unit can be adapted to be removable.

In accordance with the fifth embodiment in FIG. 8 the sound guide unit is in the form of an earmold portion. The canal 160 can be provided then in the region between the sound wall 150 and the inside wall of the third sound guide portion 140. A diaphragm 170 is provided in the canal 160 and the first and second damping units 180, 190 can be provided at the ends 161, 162.

In FIGS. 9 and 10 the sound guide unit is in the form of an ear pad. An elastic ear pad 140 can be fixed to the sound guide unit 130 and can thus seal off the sound guide unit towards the ear canal. The canal 160 can be so arranged that the opening 161 faces towards the eardrum and the opening 162 leads outwardly. As shown in FIG. 9 the canal is arranged parallel and outside the sound guide means 130.

In the embodiment of FIG. 10 the canal firstly extends parallel and within the sound guide means 130 and is then passed outwardly through same.

Figure 11:
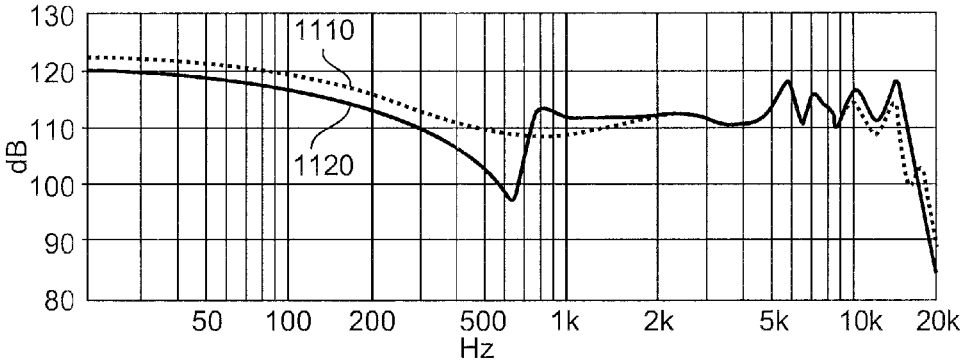
FIG. 11 shows a frequency response of an ear canal earpiece with an open and closed undamped canal according to the invention.

FIG. 11 shows a frequency response of an ear canal earpiece with an open and closed ambient canal according to the invention, wherein the canal is undamped.

Figure 12A:
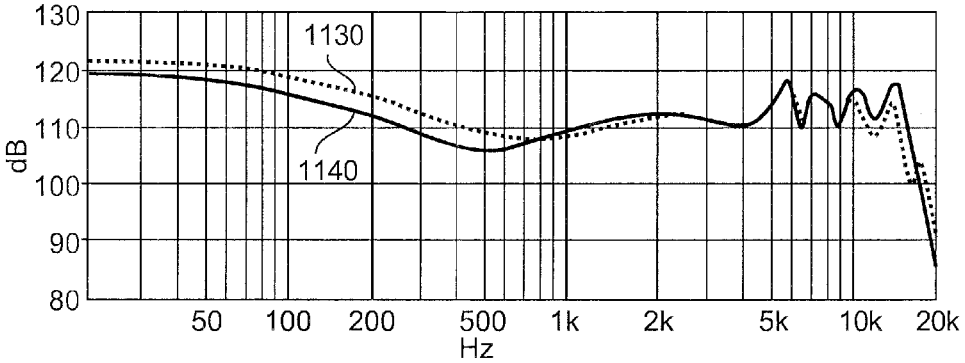
FIG. 12A shows a frequency response of an ear canal earpiece with an open and closed ambient canal according to the invention.

FIG. 12A shows a frequency response of an ear canal earpiece with an open and closed ambient canal according to the invention.

Figure 12B:
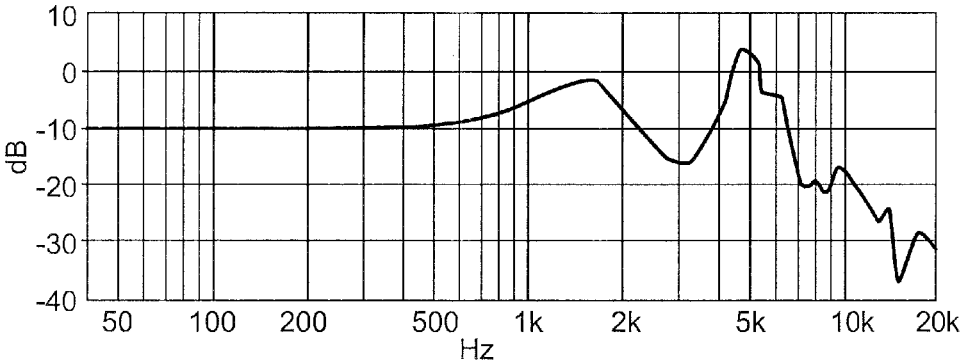
FIG. 12B shows a transfer function of an ambient canal according to the invention.

FIG. 12B shows a transfer function of an ambient canal according to the invention.

Figure 13A:
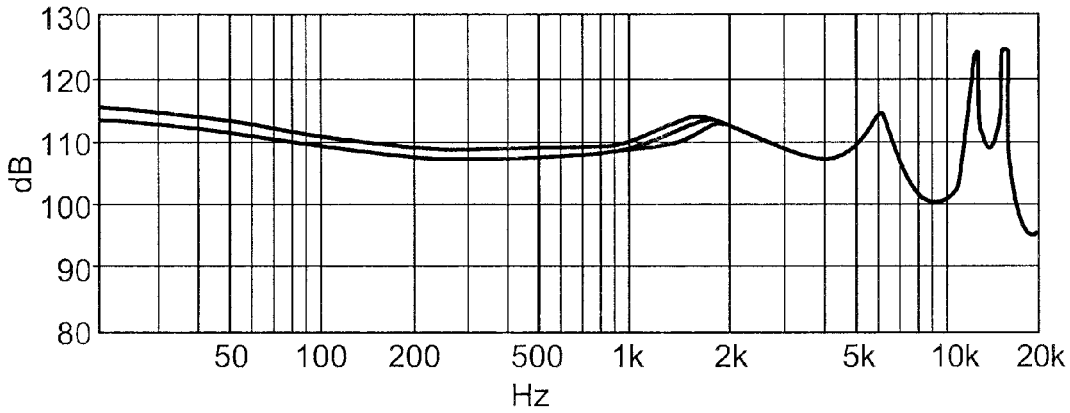
FIG. 13A shows a frequency response of an ear canal earpiece according to the invention with altered flexibility of the diaphragm in the ambient canal.

FIG. 13A shows a frequency response of an ear canal earpiece according to the invention with altered flexibility of the diaphragm in the ambient canal.

Figure 13B:
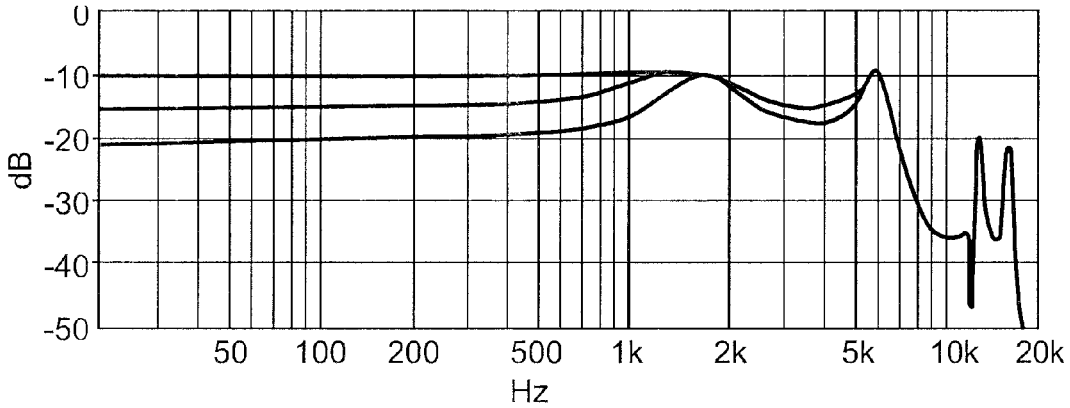
FIG. 13B shows a transfer function of an ambient canal according to the invention with altered flexibility of the diaphragm in the ambient canal.

FIG. 13B shows a transfer function of an ambient canal according to the invention with an altered flexibility of the diaphragm in the ambient canal.

Figure 14A:
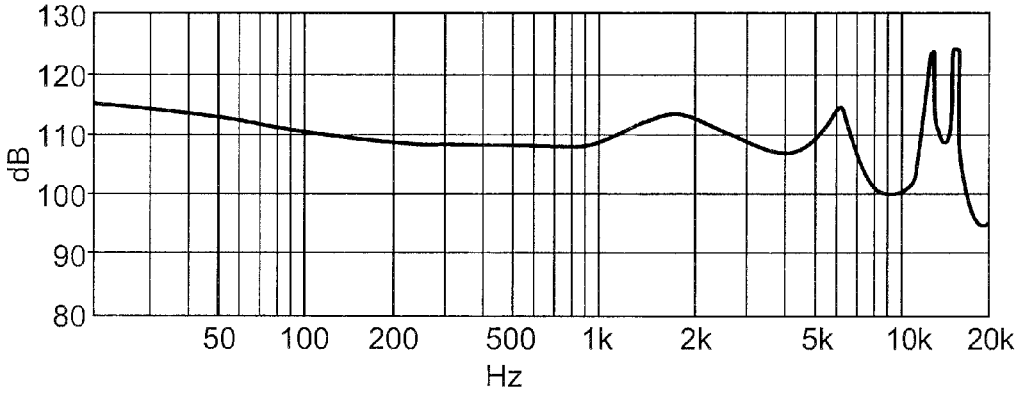
FIG. 14A shows a frequency response of an ear canal earpiece according to the invention with altered mass of the diaphragm in the ambient canal.

FIG. 14A shows a frequency response of an ear canal earpiece according to the invention with altered mass of the diaphragm in the ambient canal.

Figure 14B:
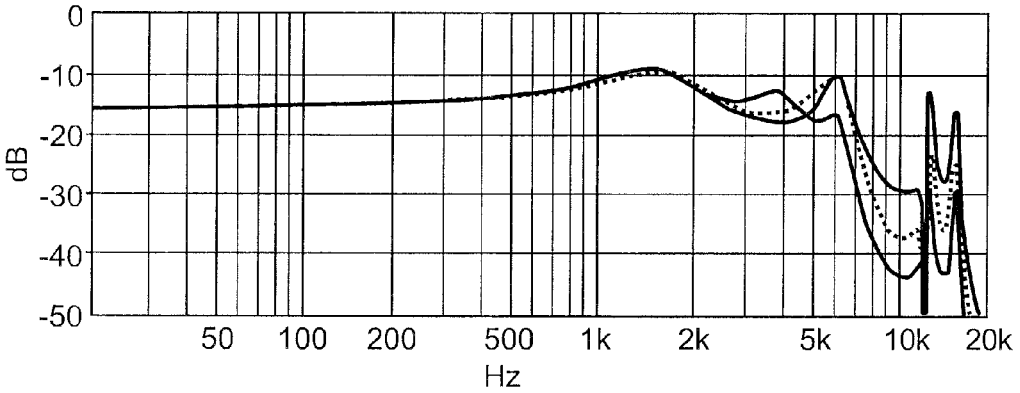
FIG. 14B shows a transfer function of an ambient canal according to the invention with altered mass of the diaphragm in the ambient canal.

FIG. 14B shows a transfer function of an ambient canal with altered mass of the diaphragm in the ambient canal according to the invention.

Figure 15A:
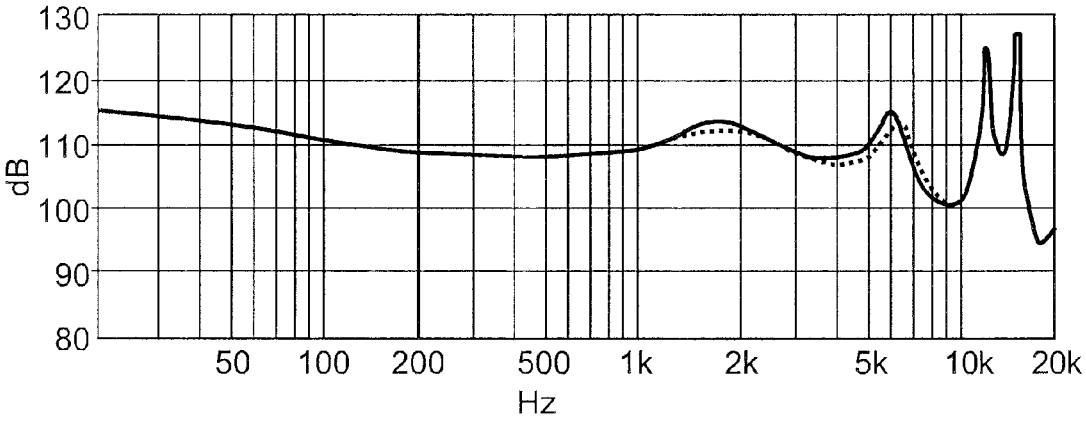
FIG. 15A shows a frequency response of an ear canal earpiece according to the invention with altered length of the canal.

FIG. 15A shows a frequency response of an ear canal earpiece according to the invention with altered length of the canal.

Figure 15B:
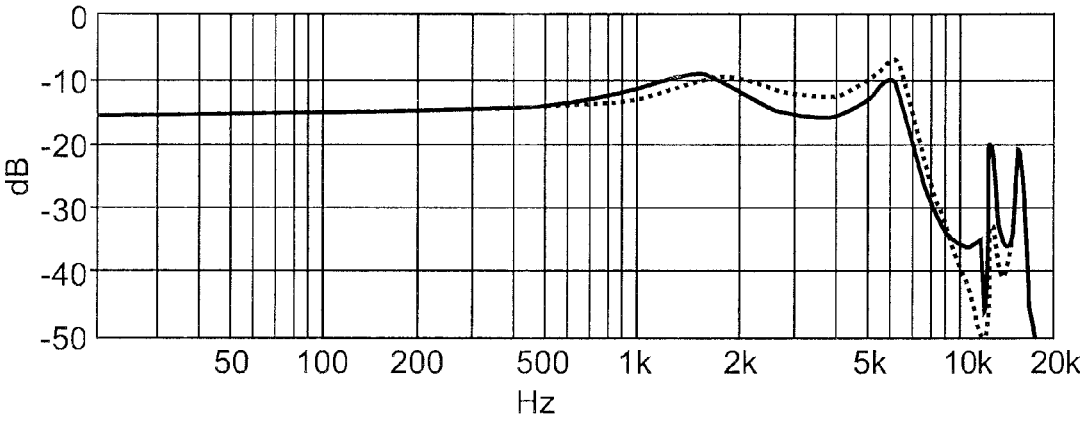
FIG. 15B shows a transfer function of an ambient canal with altered length of the canal according to the invention.

FIG. 15B shows a transfer function of an ambient canal with altered length of the canal according to the invention.

Figure 16A:
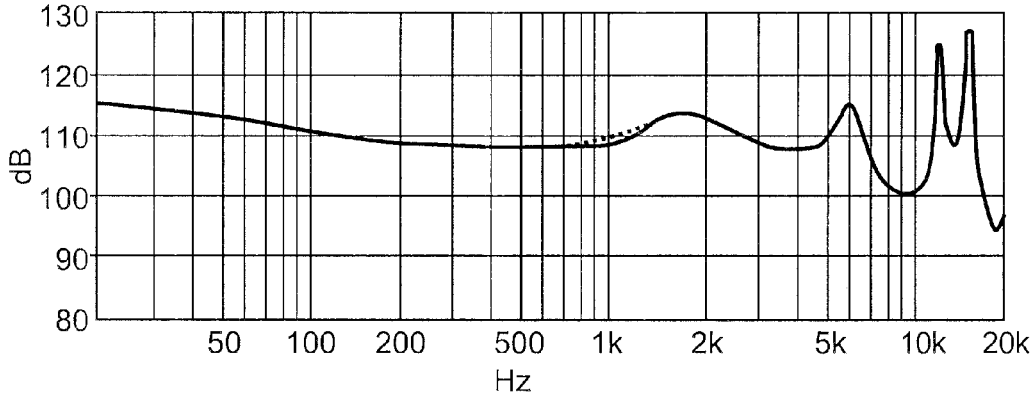
FIG. 16A shows a frequency response of an ear canal earpiece according to the invention with alteration of the damping the direction of the ear.

FIG. 16A shows a frequency response of an ear canal earpiece according to the invention with a changed damping the direction of the ear.

Figure 16B:
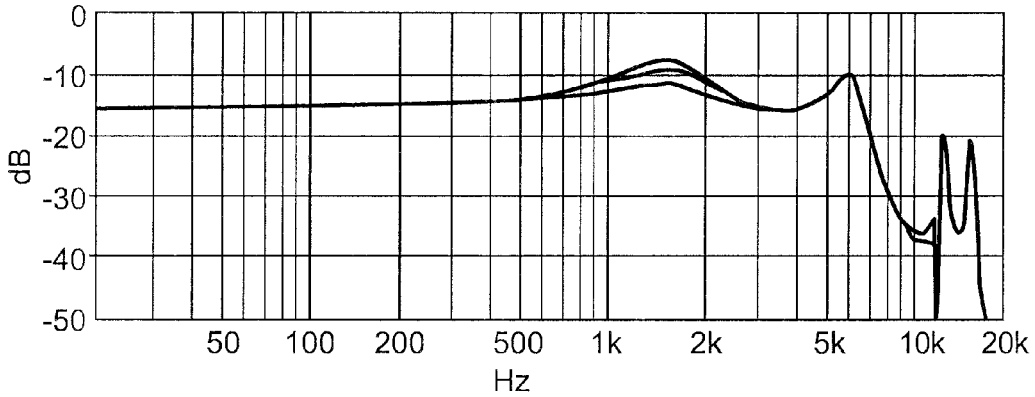
FIG. 16B shows a transfer function of an ambient canal with a change in damping in the direction of the ear.

FIG. 16B shows a transfer function of an ambient canal with a changed damping in the direction of the ear according to the invention.

Figure 17A:
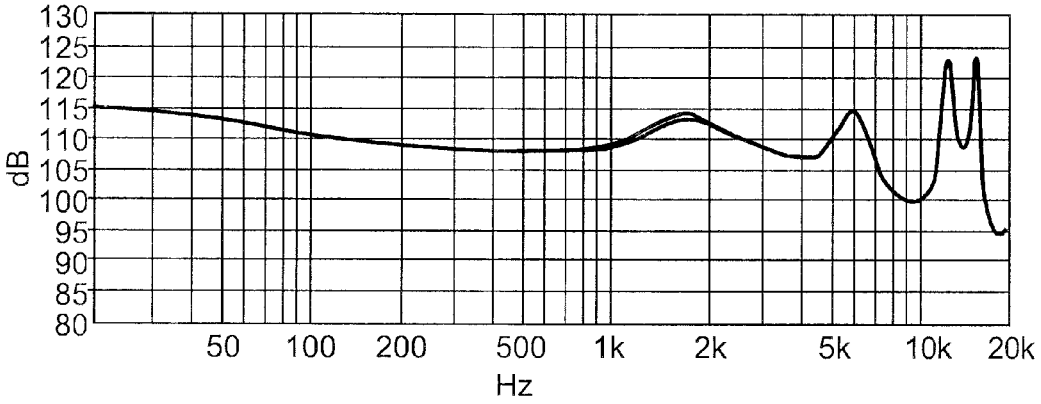
FIG. 17A shows a frequency response of an ear canal earpiece according to the invention with an alteration in damping outwardly.

FIG. 17A shows a frequency response of an ear canal earpiece according to the invention with a changed damping outwardly.

Figure 17B:
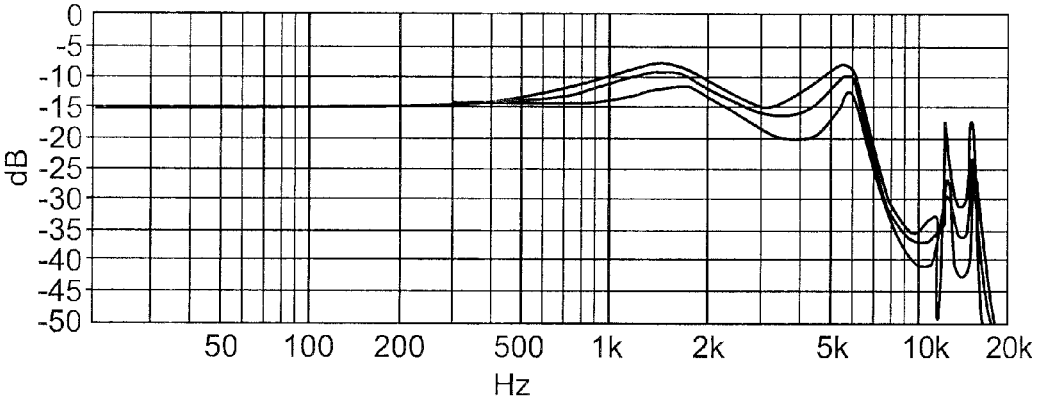
FIG. 17B shows a transfer function of an ambient canal with a change in damping outwardly.

FIG. 17B shows a transfer function of an ambient canal with a changed damping outwardly according to the invention.

According to the invention the electroacoustic sound transducer can be in the form of a dynamic or magnetic sound transducer.

The join between the earpiece and the earmold portion can be in the form of a permanent connection or in the form of a connection which can be released again by the user, for example by a latching connection.

According to the invention the second and third sound guide portions can be in the form of part of the earpiece (for example as part of the otoplastic means) or in the form of an earmold portion (earmold unit).

According to the invention the second sound guide portion can be in the form of part of the ear pad, wherein the third sound guide portion is formed by a part of the ear canal.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claim.

The invention claimed is:

1. An ear canal earpiece comprising:

an electroacoustic sound transducer;

a sound guide unit having a first and a second end for guiding a sound from the electroacoustic sound transducer to an ear of a user;

a canal having a first end open towards the ear and a second outwardly open end; and an oscillatable diaphragm which has a closed surface and which extends substantially over the entire cross-section of the canal, wherein the oscillatable diaphragm constantly seals off a volume defined by an ear canal of a user and at least one portion of the sound guide unit.

2. The ear canal earpiece as set forth in claim 1, further comprising:

a first damping unit in a region of the first end of the canal.

3. The ear canal earpiece as set forth in claim 2;

wherein the first damping unit is configured to influence the frequency response of sound transmitted through the canal or as protection against fouling.

4. The ear canal earpiece as set forth in claim 2, further comprising:

a second damping unit in a region of the second end of the canal.

5. The ear canal earpiece as set forth in claim 4;

wherein the second damping unit is configured to influence the frequency response of sound transmitted through the canal or as protection against fouling.

6. The ear canal earpiece as set forth in claim 1;

wherein the diaphragm is in the form of a flat diaphragm, a flat tensioned diaphragm, or an embossed diaphragm with a dome portion and a bead portion.

7. The ear canal earpiece as set forth in claim 1;

wherein the canal extends at least partially parallel to the sound guide unit.

8. The ear canal earpiece as set forth in claim 1;

wherein the cross-section of the canal is round or rectangular.

9. The ear canal earpiece as set forth in claim 1;

wherein the canal has an enlarged portion configured to receive a diaphragm support of the diaphragm.

10. An ear canal earpiece as set forth in claim 1;

wherein the canal includes two parts; and wherein the diaphragm is provided with a diaphragm suspension means between the two parts of the canal.

11. The ear canal earpiece as set forth in claim 1, further comprising:

a damping unit in a region of the end of the canal.

12. The ear canal earpiece as set forth in claim 11;

wherein the damping unit is configured to influence the frequency response of sound transmitted through the canal or as protection against fouling.

13. The ear canal earpiece as set forth in claim 1;

wherein the ear canal earpiece is configured to be fitted into an ear canal of a user such that the ear canal earpiece substantially air-tightly closes the ear canal of a user.

14. The ear canal earpiece as set forth in claim 1;

wherein the canal is arranged parallel to the at least one portion.

15. The ear canal earpiece as set forth in claim 1;

wherein the oscillatable diaphragm seals off the volume for frequencies below its resonance frequency such that the oscillatable diaphragm is capable of passing sound from an exterior.

16. An ear canal earpiece comprising:

an electroacoustic sound transducer;

a sound guide unit having a first and a second end for guiding a sound from the electroacoustic sound transducer to an ear of a user;

a canal having a first end open towards the ear and a second outwardly open end; and an oscillatable diaphragm which has a closed surface and which extends substantially over an entire cross-section of the canal, wherein the oscillatable diaphragm constantly seals off a volume defined by an ear canal of a user and the ear canal earpiece, and wherein the ear canal earpiece is configured to be fitted into the ear canal of the user such that the ear canal earpiece substantially air-tightly closes the ear canal of the user.

* * * * *